US008183187B2

(12) United States Patent
Sumiejski et al.

(10) Patent No.: US 8,183,187 B2
(45) **Date of Patent: *May 22, 2012**

(54) LUBRICANT ADDITIVE FORMULATION CONTAINING MULTIFUNCTIONAL DISPERSANT

(75) Inventors: James L. Sumiejski, Mentor, OH (US); Craig D. Tipton, Perry, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 442 days.

This patent is subject to a terminal disclaimer.

(21) Appl. No.: 11/816,206

(22) PCT Filed: Feb. 8, 2006

(86) PCT No.: PCT/US2006/004319

§ 371 (c)(1),
(2), (4) Date: Feb. 5, 2008

(87) PCT Pub. No.: WO2006/091371

PCT Pub. Date: Aug. 31, 2006

(65) Prior Publication Data

US 2008/0248980 A1 Oct. 9, 2008

Related U.S. Application Data

(60) Provisional application No. 60/654,726, filed on Feb. 18, 2005.

(51) Int. Cl.
*C10M 163/00* (2006.01)
*C10M 159/12* (2006.01)

(52) U.S. Cl. ..... 508/185; 508/188; 508/192; 508/273

(58) Field of Classification Search ..... 508/287, 508/185, 273, 162, 192
See application file for complete search history.

(56) References Cited

U.S. PATENT DOCUMENTS

| | | | | |
|---|---|---|---|---|
| 3,172,892 | A | 3/1965 | Le Suer et al. | 260/326.5 |
| 3,287,271 | A | 11/1966 | Stuart et al. | |
| 3,374,174 | A | 3/1968 | Le Suer | |
| 3,381,022 | A | 4/1968 | Le Suer | 260/404.8 |
| 3,411,369 | A | 11/1968 | Hammann et al. | 74/200 |
| 3,708,522 | A | 1/1973 | Le Seur | |
| 4,136,043 | A | 1/1979 | Davis | 252/47.5 |
| 4,234,435 | A | 11/1980 | Meinhardt et al. | 252/51.5 A |
| 4,704,490 | A | 11/1987 | Tsubouchi et al. | 585/1 |
| 4,724,091 | A | 2/1988 | Davis | |
| 5,164,103 | A | 11/1992 | Papay | 252/49.9 |
| 5,182,037 | A * | 1/1993 | Pialet et al. | 508/192 |
| 5,330,667 | A * | 7/1994 | Tiffany et al. | 508/192 |
| 5,344,579 | A | 9/1994 | Ohtani et al. | 252/51.5 R |
| 5,407,453 | A | 4/1995 | Pierce-Ruhland et al. | 44/411 |
| 5,597,785 | A | 1/1997 | Karol | 508/274 |
| 5,697,988 | A | 12/1997 | Malfer et al. | |
| 6,103,673 | A | 8/2000 | Sumiejski et al. | 508/186 |
| 6,251,840 | B1 * | 6/2001 | Ward et al. | 508/162 |
| 6,348,075 | B1 | 2/2002 | Jackson | |
| 6,451,745 | B1 * | 9/2002 | Ward | 508/192 |
| 6,458,172 | B1 | 10/2002 | Macduff et al. | 44/348 |
| 6,528,458 | B1 * | 3/2003 | Tagliamonte et al. | 508/185 |
| 7,902,130 | B2 * | 3/2011 | Baumanis et al. | 508/185 |
| 2003/0224948 | A1 | 12/2003 | Dam et al. | 508/192 |
| 2005/0041395 | A1 | 2/2005 | Tipton et al. | 361/715 |
| 2006/0084583 | A1 * | 4/2006 | Tipton et al. | 508/287 |
| 2009/0054278 | A1 | 2/2009 | Baumanis | |

FOREIGN PATENT DOCUMENTS

| | | |
|---|---|---|
| EP | 1077249 | 2/2001 |
| WO | WO 03/089553 | 10/2003 |
| WO | WO 2005/021692 | 3/2005 |
| WO | 2006045044 | 4/2006 |
| WO | WO 2007/044820 | 4/2007 |

OTHER PUBLICATIONS

Corresponding PCT Publication WO 2006/091371 Al and Search Report; date of publication of Search Report: Jul. 19, 2006.
"Chemistry and Technology of Lubricants", Edited by R. M. Mortier and St. T. Orszulik, p. 88, Blackie Academic & Professional, London (1992).

* cited by examiner

*Primary Examiner* — Ellen McAvoy
*Assistant Examiner* — Latosha Hines
(74) *Attorney, Agent, or Firm* — David M. Shold; Christopher D. Hilker

(57) ABSTRACT

The present invention provides a lubricating composition comprising (a) an oil of lubricating viscosity; (b) a friction modifier; (c) a corrosion inhibitor; (d) an antiwear agent; and (e) a product prepared by heating together: (i) a dispersant; (ii) 2,5-dimercapto-1,3,4-thiadiazole or a hydrocarbyl-substituted 2,5-dimercapto-1,3,4-thiadiazole, or oligomers thereof; (iii) a borating agent;and (iv) optionally a dicarboxylic acid of an aromatic compound selected from the group consisting of 1,3 diacids and 1,4 diacids, or (v) optionally a phosphorus acid compound, said heating being sufficient to provide a product of (i), (ii), (iii) and optionally (iv), which is soluble in an oil of lubricating viscosity. The invention further provides a use for the lubricating composition in a transmission.

18 Claims, No Drawings

LUBRICANT ADDITIVE FORMULATION CONTAINING MULTIFUNCTIONAL DISPERSANT

FIELD OF INVENTION

The present invention relates to a lubricant additive formulation containing a multifunctional dispersant and its use in a lubricating composition, for example in automatic transmission fluids.

BACKGROUND OF THE INVENTION

Automatic transmission fluids (ATFs) present highly challenging technological problems and solutions for satisfying the multiple and often conflicting lubricating and power transmitting requirements of modern automatic transmissions (including continuously variable transmissions of various types). Many additive components are typically included in an ATF, providing such performance characteristics as lubrication, dispersancy, friction control (for clutches), anti-wear performance, anti-shudder performance, anti-corrosion and anti-oxidation performance. Finding and providing the correctly balanced composition is a significant formulating challenge. Furthermore.

Examples of formulations that have been employed in the past include those represented by U.S. Pat. No. 5,164,103, Papay, Nov. 17, 1992, which discloses preconditioned ATFs made by using a preblend formed by heating an alkenyl succinimide or succinimide detergent with a phosphorus ester and water to partially hydrolyze the ester, and then mixing the preblend and other additives with a base oil. Boronating agents may also be used. Thiadiazole derivatives may be included as another additive.

U.S. Pat. No. 5,344,579, Ohtani et al, Sep. 6, 1994, discloses a friction modifier composition which may be used in a wet clutch or wet brake system. The composition comprises a hydroxyalkyl aliphatic imidazoline and a di(hydroxyalkyl) aliphatic tertiary amine. The compositions may also contain a phosphorus-containing ashless dispersant and/or a boron-containing ashless dispersant. Among other components are copper corrosion inhibitors such as 2,5-dimercapto-3,4,-thiadiazole.

U.S. Pat. No. 6,251,840, Ward, Jr. et al., Jun. 26, 2001, discloses an automatic transmission fluid comprising a majority of an oil having a certain viscosity, 0.025-5 weight percent 2,5-dimercapto-1,3,4-thiadiazole (DMTD) or one or more derivatives of DMTD, an antifoam agent, and 0.01-0.3 weight percent of 85% phosphoric acid. Derivatives of DMTD include products from combining an oil soluble dispersant with DMTD. These may be obtained by mixing a thiadiazole, preferably DMTD with an oil-soluble carboxylic dispersant in a diluent by heating the mixture above about 100° C.

U.S. Pat. No. 4,136,043, Davis, Jan. 23, 1979, discloses compositions which form homogeneous blends with lubricating oils and the like, produced by preparing a mixture of an oil-soluble dispersant and a dimercaptothiadiazole and heating the mixture above about 100° C. The compositions are useful for suppression of copper activity and "lead paint" deposition in lubricants.

U.S. Patent Application 2003/0224948, Van Dam et al., published Dec. 4, 2003, discloses an additive formulation containing ethylene carbonate polyalkene succinimides, borated dispersants and dispersed aromatic dicarboxylic acid corrosion inhibitors that are succinimide salts of one or more aromatic dicarboxylic acids.

The present invention solves the problem of providing a lubricating composition, especially for an ATF capable of providing at least one property from acceptable friction performance and durability, acceptable anti-shudder performance, acceptable oxidation resistance and acceptable gear protection.

SUMMARY OF THE INVENTION

The present invention provides a lubricating composition comprising:

(a) an oil of lubricating viscosity;
(b) a friction modifier;
(c) a corrosion inhibitor;
(d) an antiwear agent; and
(e) a product prepared by heating together:
(i) a dispersant;
(ii) 2,5-dimercapto-1,3,4-thiadiazole or a hydrocarbyl-substituted 2,5-dimercapto-1,3,4-thiadiazole, or oligomers thereof;
(iii) a borating agent; and
(iv) optionally a dicarboxylic acid of an aromatic compound selected from the group consisting of 1,3 diacids and 1,4 diacids; or
(v) optionally a phosphorus acid compound, said heating being sufficient to provide a product of (i), (ii), (iii) and optionally (iv) or (v), which is soluble in an oil of lubricating viscosity.

The invention further provides a method for lubricating a mechanical device such as a transmission, comprising supplying thereto said lubricating composition.

DETAILED DESCRIPTION OF THE INVENTION

Oil of Lubricating Viscosity

One component of the present invention is an oil of lubricating viscosity. In one embodiment the lubricating composition includes natural or synthetic oils of lubricating viscosity, oil derived from hydrocracking, hydrogenation, hydrofinishing, unrefined, refined and re-refined oils or mixtures thereof.

Natural oils include animal oils, vegetable oils, mineral oils or mixtures thereof. Synthetic oils include a hydrocarbon oil, a silicon-based oil, a liquid esters of phosphorus-containing acid. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. In several embodiments the oil of lubricating viscosity comprises an API Group I, II, III, IV, V, VI or mixtures thereof, or an API Group I, II, III or mixtures thereof. If the oil of lubricating viscosity is an API Group II, III, IV, V or VI oil there may be up to a maximum of 40 wt % or up to a maximum of 10 wt % or 5 wt % of the lubricating oil being an API Group I oil.

In one embodiment, the oil of lubricating viscosity is a poly-alpha-olefin (PAO). In one embodiment the poly-α-olefin is derived from oligomers comprising 1-decene. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as base oils are highly hydrocracked and dewaxed oils. These petroleum oils are generally refined to give enhanced low temperature viscosity and antioxidation performance. Mixtures of synthetic oils with refined mineral oils may also be employed.

Another class of oils is known as traction oils, which are typically synthetic fluids containing a large fraction of highly branched or cycloaliphatic structures, i.e., cyclohexyl rings. Traction oils or traction fluids are described in detail, for example, in U.S. Pat. Nos. 3,411,369 and 4,704,490.

In several embodiments the oil of lubricating viscosity is present from 15 wt % to 99.9 wt %, or from 40 wt % to 99.4 wt %, or from 62 wt % to 98.9 wt %, or from 74 wt % to 97.3 wt % of the lubricating composition.

Antiwear Agent

The lubricating composition further comprises an antiwear agent or mixtures thereof. In several embodiments the amount of antiwear agent present in the lubricating composition ranges from 0.01 wt % to 15 wt %, 0.05 wt % to 10 wt %, 0.075 wt % to 5 wt % or 0.1 wt % to 3 wt % of the lubricating composition.

The antiwear agent includes compounds such as metal thiophosphates, such as zinc dialkyldithiophosphates; phosphoric acid esters or salt thereof; hydrocarbyl-substituted phosphites, phosphorus-containing carboxylic esters, phosphorus-containing carboxylic ethers, and phosphorus-containing carboxylic amides, or mixtures thereof. In one embodiment the antiwear agent includes a hydrocarbyl-substituted phosphite, a phosphorus-containing carboxylic ester, a phosphorus-containing carboxylic ether, a phosphorus-containing carboxylic amide, or mixtures thereof.

In one embodiment the antiwear agent is a hydrocarbyl-substituted phosphite. The hydrocarbyl-substituted phosphite of the invention includes those represented by the formula:

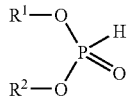

(I)

wherein $R^1$ and $R^2$ are independently hydrogen or hydrocarbyl groups, with the proviso that at least one of $R^1$ and $R^2$ is a hydrocarbyl group.

When $R^1$ and/or $R^2$ are hydrocarbyl groups, each may contain at least 2 or 4 carbon atoms. Typically, the combined total sum of carbon atoms present on $R^1$ and $R^2$ is less than 45, less than 35 or less than 25. Examples of suitable ranges for the number of carbon atoms present on $R^1$ and/or $R^2$ include 2 to 40, 3 to 20 or 4 to 10. Examples of suitable hydrocarbyl groups include propyl, butyl, t-butyl, pentyl or hexyl groups. Generally the hydrocarbyl-substituted phosphite is soluble or at least dispersible in oil.

Friction Modifier

The lubricating composition further comprises a friction modifier. The friction modifier includes at least one of an amide of a hydroxyalkyl compound, a condensation product of a fatty acid and an amine, a borated glycerol ester, a fatty phosphite, a fatty acid amide, a fatty epoxide, a borated fatty epoxide, an alkoxylated fatty amine, a borated alkoxylated fatty amine, a metal salts of a fatty acid, a fatty imidazoline, a polyalkoxylated alcohol (such as a polyethoxylated alcohol e.g. $C_{12}$-alcohol with two or more pendant ethoxylated groups), an amine salt of an alkylphosphoric acid, or mixtures thereof.

In one embodiment the friction modifier is a condensation product of a fatty acid and an amine including condensation products of fatty acids and polyalkylene-polyamines or condensation products of fatty acids and monoamines.

In one embodiment the friction modifier is an amide of a hydroxyalkyl compound. The friction modifier is formed by the condensation of the hydroxyalkyl compound with an acylating agent or an amine. A more detailed description of the hydroxyalkyl compound is described in U.S. patent application 60/725,360 (filed on Oct. 11, 2005, inventors Bartley, Lahiri, Baker and Tipton) in paragraphs 8, 19-21. Preparative Examples are disclosed in Examples 1 and 2 (paragraphs 68 and 69). In one embodiment the amide of a hydroxylalkyl compound is prepared by reacting glycolic acid, that is, hydroxyacetic acid, HO—$CH_2$—COOH with an amine.

In several embodiments the amount of friction modifier present in the lubricating composition ranges from 0.01 wt % to 15 wt %, 0.05 wt % to 10 wt %, 0.075 wt % to 5 wt % or 0.1 wt % to 3 wt % of the lubricating composition.

In one embodiment the friction modifier is a condensation product of a fatty acid and an amine or mixtures thereof. The amine may be a polyamine or a monoamine. When the condensation of a fatty acid and an amine is a monoamine the product may be an amide-ester.

Examples of monoamines include methylamine, ethylamine, propylamine, butylamine, octylamine, and dodecylamine. Examples of secondary monoamines include di-cocoalkyl amine ((or di-cocoamine) is a secondary amine with two alkyl groups that are predominantly $C_{12}$ groups (although amounts of $C_8$ through $C_{18}$ are generally also present)), derived from coconut oil, dimethylamine, diethylamine, dipropylamine, dibutylamine, methylbutylamine, and ethylhexylamine. The monoamine may also be an aminoalcohol containing 1 to 6 or 1 to 4 hydroxyl groups. Examples of aminoalcohols include tri-(hydroxypropyl)amine, tris-(hydroxymethyl)amino methane, 2-amino-2-methyl-1,3-propanediol, N,N,N',N'-tetrakis(2-hydroxy-propyl)ethylenediamine, and N,N,N',N'-tetrakis(2-hydroxyethyl)ethylenediamine.

The polyamines may be acyclic or cyclic. In one embodiment the polyamines may be alkylenepolyamines selected from the group consisting of ethylenepolyamines, propylenepolyamines, butylenepolyamines and mixtures thereof. Examples of propylenepolyamines can include propylenediamine and dipropylenetriamine.

In one embodiment the ethylenepolyamines are selected from the group consisting of ethylenediamine, diethylenetriamine, triethylenetetramine, tetraethylenepentamine, pentaethylenehexamine, N-(2-aminoethyl)-N'-[2-[(2-aminoethyl)amino]ethyl]-1,2-ethanediamine, polyamine still bottoms and mixtures thereof.

In one embodiment the fatty acid is condensed with a polyamine. Typically the condensation product may be at least one compound selected from hydrocarbyl amides, hydrocarbyl imidazolines and mixtures thereof. In one embodiment the condensation products are hydrocarbyl imidazolines. In one embodiment the condensation products are hydrocarbyl amides. In one embodiment the condensation products are mixtures of hydrocarbyl imidazolines and hydrocarbyl amides. In one embodiment the condensation product is mixtures of hydrocarbyl imidazolines and hydrocarbyl amides.

The fatty acid of the invention may be derived from a hydrocarbyl carboxylic acid. The hydrocarbyl group of the fatty acid typically contains 8 or more, 10 or more, 13 or more or 14 or more carbon atoms (including the carbon of the carboxy group). The number of carbon atoms present on the fatty acid typically ranges from 8 to 30, 12 to 24 or 16 to 18. Other suitable carboxylic acids can include the polycarboxylic acids or carboxylic acids or anhydrides having from 2 to 4 carbonyl groups, for instance 2. The polycarboxylic acids may include succinic acids and anhydrides and Diels-Alder reaction products of unsaturated monocarboxylic acids with unsaturated carboxylic acids (such as acrylic, methacrylic, maleic, fumaric, crotonic and itaconic acids). In several embodiments the fatty carboxylic acids are fatty monocarboxylic acids containing 8 to 30, 10 to 26 or 12 to 24 carbon atoms.

Examples of suitable fatty acids can include caprylic acid, capric acid, lauric acid, myristic acid, palmitic acid, isostearic acid, stearic acid, eicosic acid and, tall oil acids.

Corrosion Inhibitor

The lubricating composition further comprises a corrosion inhibitor or mixtures thereof. In one embodiment the corrosion inhibitor also exhibits antiwear properties.

In several embodiments the amount of corrosion inhibitor present in the lubricating composition ranges from 0.001 wt % to 10 wt %, 0.005 wt % to 5 wt %, 0.01 wt % to 3 wt % or 0.02 wt % to 2 wt % of the lubricating composition.

The corrosion inhibitors of the invention include octylamine octanoate, condensation products of dodecenyl succinic acid or anhydride, a dimercaptothiadiazole and reactive equivalents thereof, or mixtures thereof.

In one embodiment the corrosion inhibitor is a dimercaptothiadiazole. Examples of a suitable dimercaptothiadiazole include 2,5-dimercapto-1,3-4-thiadiazole or a hydrocarbyl-substituted 2,5-dimercapto-1,3-4-thiadiazole. In several embodiments the number of carbon atoms on the hydrocarbyl-substituent group includes 1 to 30, 2 to 25, 4 to 20, or 6 to 16. Examples of suitable 2,5-bis(alkyl-dithio)-1,3,4-thiadiazoles include 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-pentadecyldithio)-1,3,4-thiadiazole, 2,5-bis(tert-hexadecyldithio)-1,3,4-thiadiazole, 2,5-bis(tert-heptadecyldithio)-1,3,4-thiadiazole, 2,5-bis(tert-octadecyldithio)-1,3,4-thiadiazole, 2,5-bis(tert-nonadecyldithio)-1,3,4-thiadiazole or 2,5-bis(tert-eicosyldithio)-1,3,4-thiadiazole, or oligomers thereof.

Product Prepared by Heating

The lubricating composition further comprises a product prepared by heating together: (i) a dispersant; (ii) 2,5-dimercapto-1,3,4-thiadiazole or a hydrocarbyl-substituted 2,5-dimercapto-1,3,4-thiadiazole, or oligomers thereof; (iii) a borating agent; and (iv) optionally a dicarboxylic acid of an aromatic compound selected from the group consisting of 1,3 diacids and 1,4 diacids, said heating being sufficient to provide a product of (i), (ii), (iii) and optionally (iv), which is soluble in an oil of lubricating viscosity.

The product prepared by heating may be present in the lubricating composition in the range 0.1 wt % to 20 wt %, 0.5 wt % to 15 wt %, 1 wt % to 10 wt % or 2 wt % to 8 wt % of the lubricating composition.

The mixture of dispersant, dicarboxylic acid of an aromatic compound and the mercaptothiadiazole is treated with a borating agent and optionally also with a phosphorus acid or anhydride. The components may be combined and reacted in any order. In particular, the borating agent may be a pretreatment process or a post-treatment process. Thus, for instance, boric acid (and optionally also phosphoric acid) may be reacted with a dispersant in one step, and thereafter the intermediate borated dispersant may be reacted with the mercaptothiadiazole and the dicarboxylic acid of an aromatic compound. Alternatively, the dispersant, dicarboxylic acid of an aromatic compound and mercapthothiadiazole may be first reacted, and then the product treated with a borating agent (and optionally with phosphoric acid, a phosphorus acid). In yet another variation, a phosphorylated succinimide dispersant may be prepared by reacting a phosphorus acid with a hydrocarbyl-substituted succinic anhydride to prepare a mixed anhydride-acid precursor, and then reacting the precursor with a polyamine to form a phosphorus-containing dispersant. The phosphorus-containing dispersant may thereafter be reacted with the dicarboxylic acid of an aromatic compound and mercaptothiadiazole; and with the borating agent.

The components are typically reacted by heating the borating agent and optionally the phosphorus acid compound (together or sequentially) with the remaining components, that is, with the dispersant, dicarboxylic acid of an aromatic compound and the dimercaptothiadiazole, although other orders of reaction are possible, as described above. The heating will be at a sufficient time and temperature to assure solubility of resulting product, typically 80-200° C., or 90-180° C., or 120-170° C., or 150-170° C. The time of reaction is typically at least 0.5 hours, for instance, 1-24 hours, 2-12 hours, 4-10 hours, or 6-8 hours. The length of time required for the reaction is determined in part by the temperature of the reaction, as will be apparent to one skilled in the art. Progress of the reaction is generally evidenced by the evolution of $H_2S$ or water from the reaction mixture. Typically, the $H_2S$ is derived from one or more of the sulfur atoms in the dimercaptothiadiazole.

The reaction product may typically contain 0.5 to 2.5 weight percent sulfur derived from component (iii), or 1 to 2 weight percent, or 1.25 to 1.5 weight percent sulfur. It may likewise contain 0.2 to 0.6 weight percent boron from component (iv), or 0.3 to 1.1 percent phosphorus from component (e), or such amounts from both components (iv) and (v).

The reaction may be conducted in a hydrophobic medium such as an oil of lubricating viscosity which may, if desired, be retained in the final product. The oil, however, should typically be an oil which does not itself react or decompose under conditions of the reaction. Thus, oils containing reactive ester functionality are typically not used as diluent. Oils of lubricating viscosity are described in greater detail above.

In the absence of the dicarboxylic acid, the relative amounts of the components which are reacted are, expressed as parts by weight prior to reaction are typically 100 parts of (i) the dispersant, per 0.75 to 6 parts of (ii) the dimercaptothiadiazole or substituted dimercaptothiadiazole, and 0 or 0.01 to 7.5 parts of (iii) the borating agent, and 0.01 to 7.5 parts of (v) the phosphorus acid compound, provided that the relative amount of (iii)+(v) is at least 0.075 parts. In one embodiment the relative amounts are 100 parts of (i), 1.5 to 3 parts of (ii), 0 to 4.5 parts of (iii), and 0 to 4.5 parts of (v), provided that (iii)+(v) is at least 1.5 parts. In another embodiment, the relative amounts are 100 parts (i):1.5 to 2.2 parts (ii):3.7 to 4.4 parts (iii):1.5 to 4.4 parts (v). The amounts, and ranges of the various components, in particular, (iii) and (v), may be independently combined so that there may be, for instance, 3.7 to 4.4 parts of (iii) whether or not any of (v) is present, and likewise there may be 1.5 to 4.4 parts (v) whether or not any of (iii) is present.

When the dicarboxylic acid is present, relative amounts of the components which are reacted are, expressed as parts by weight prior to reaction are typically 100 parts of (i) the dispersant, per 5-5000 parts per million of (ii) the dicarboxylic acid of an aromatic compound, 0.75 to 6 parts of (iii) the dimercaptothiadiazole or substituted dimercaptothiadiazole, and 0 to 7.5 parts of (iv) the borating agent and 0 to 7.5 parts of (v) the phosphorus acid compound, provided that the relative amount of (ii)+(iii)+(iv)+(v) is at least 1.5 parts. In a one embodiment the relative amounts are 100 parts of (i), 1.5 to 6 parts of (ii), 5-1000 parts per million of (iii), 0 or 0.01 to 4.5 parts of (iv), and 0 to 4.5 parts of (v), provided that (iii)+(iv)+(v) is at least 1.5 parts. In another embodiment, the relative amounts are 100 parts (i):1.5 to 5.0 parts (ii):25-500 parts per million (iii):3.7 to 4.4 parts (iv):0 to 4.4 parts (v). The amounts and ranges of the various components, in particular, (iv) and (v), may be independently combined so that there may be, for instance, 3.7 to 4.4 parts of (iv) whether or not any of (v) is present, and likewise there may be 1.5 to 4.4 parts (v) whether or not any of (iv) is present.

(i) The Dispersant

The product prepared by heating comprises a dispersant. The dispersant of the invention is well known and include a succinimide dispersant (for example N-substituted long chain alkenyl succinimides), a Mannich dispersant, an ester-containing dispersant, a condensation product of a fatty hydrocarbyl monocarboxylic acylating agent with an amine or ammonia, an alkyl amino phenol dispersant, a hydrocarbylamine dispersant, a polyether dispersant, a polyetheramine dispersant, a viscosity modifier containing dispersant functionality (for example polymeric viscosity index modifiers (VMs) containing dispersant functionality), or mixtures thereof.

Generally the dispersant suitable for preparing component (e) of the present invention is described in U.S. patent application Ser. No. 04/027,094 and further described in co-pending application by (Baumanis, C; Baker, M; and Tipton, C titled "Multifunctional Dispersants").

In several embodiments the N-substituted long chain alkenyl succinimides contain an average of at least 8, or 30, or 35 up to 350, or to 200, or to 100 carbon atoms. In one embodiment, the long chain alkenyl group is derived from a polyalkene characterised by an $\overline{M}_n$ (number average molecular weight) of at least 500. Generally, the polyalkene is characterised by $\overline{M}_n$ of 500, or 700, or 800, or even 900 up to 5000, or to 2500, or to 2000, or even to 1500 or 1200. In one embodiment the long chain alkenyl group is derived form polyolefins. The polyolefins may be derived from monomers including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful polyolefins include polyisobutylenes having a number average molecular weight of 140 to 5000, in another instance of 400 to 2500, and in a further instance of 140 or 500 to 1500. The polyisobutylene may have a vinylidene double bond content of 5 to 69%, in a second instance of 50 to 69%, and in a third instance of 50 to 95%.

Succinimide dispersants and their methods of preparation are more fully described in U.S. Pat. Nos. 4,234,435 and 3,172,892.

Another class of dispersant is ester-containing dispersants, which are typically high molecular weight esters. These materials are described in more detail in U.S. Pat. No. 3,381,022.

Mannich dispersants are the reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, which are commercially available.

Hydrocarbyl-amine dispersants are hydrocarbyl-substituted amines. The hydrocarbyl-substituted amine may be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines and their methods of preparation are described in greater detail in U.S. Pat. No. 6,458,172, columns 4 and 5.

Viscosity Modifiers Containing Dispersant Functionality

Polymeric viscosity index modifiers (VMs) are extremely well known in the art and most are commercially available. When dispersant functionality is incorporated onto the viscosity modifier, the resulting material is commonly referred to as a dispersant viscosity modifier. For example, a small amount of a nitrogen-containing monomer may be copolymerised with alkyl methacrylates, thereby imparting dispersancy properties into the product. Thus, such a product has the multiple function of viscosity modification and dispersancy, and sometimes also pour point depressancy. Vinyl pyridine, N-vinyl pyrrolidone and N,N'-dimethylaminoethyl methacrylate are examples of nitrogen-containing monomers which may be copolymerised with other monomers such as alkyl methacrylates to provide dispersant viscosity modifiers.

(ii) The Dimercaptothiadiazole

The present invention further comprises a dimercaptothiadiazole which is reacted as a part of the "product prepared by heating."This is in addition to any dimercaptothiadiazole which may be present within a lubricating composition as a separate corrosion inhibitor. Examples include 2,5-dimercapto-1,3-4-thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

The number of carbon atoms on the hydrocarbyl substituents in several embodiments range from 1 to 30, 2 to 20 or 3 to 16.

In one embodiment the hydrocarbyl-substituted mercaptothiadizoles (as well as the unsubstituted materials) are typically substantially soluble at 25° C. in non-polar media such as an oil of lubricating viscosity. Thus, the total number of carbon atoms in the hydrocarbyl-substituents, which tend to promote solubility, will generally be 8 or more, or 10 or more, or at least 12. If there are multiple hydrocarbyl substituents, typically each substituent will contain 8 or fewer carbon atoms.

In one embodiment the hydrocarbyl-substituted mercaptothiadizoles (as well as the unsubstituted materials) are typically substantially insoluble at 25° C. in non-polar media such as an oil of lubricating viscosity. Thus, the total number of carbon atoms in the hydrocarbyl-substituents, which tend to promote solubility, will generally be fewer than 8, or 6, or 4. If there are multiple hydrocarbyl substituents, typically each substituent will contain 4 or fewer carbon atoms.

By the term "substantially insoluble" it is meant that the dimercaptothiadiazole (DMTD) compound will typically dissolve to an extent of less than 0.1 weight percent, or less than 0.01 or 0.005 weight percent in oil at room temperature (25° C.). A suitable hydrocarbon oil of lubricating viscosity in which the solubility may be evaluated is Chevron™ RLOP 100 N oil. The specified amount of the DMTD or substituted DMTD is mixed with the oil and the solubility may be evaluated by observing clarity versus the appearance of residual sediment after, e.g., 1 week of storage.

(iii) Borating Agent

The borating agent includes various forms of boric acid (including metaboric acid, $HBO_2$, orthoboric acid, $H_3BO_3$, and tetraboric acid, $H_2B_4O_7$), boric oxide, boron trioxide, and an alkyl borate, such as those of the formula $(RO)_xB(OH)_y$ wherein x is 1 to 3 and y is 0 to 2, the sum of x and y being 3, and where R is an alkyl group containing 1 to 6 carbon atoms. In one embodiment, the boron compound is an alkali or mixed alkali metal and alkaline earth metal borate. These metal borates are generally a hydrated particulate metal borate which are known in the art. Alkali metal borates include mixed alkali and alkaline metal borates. These metal borates are available commercially.

(iv) Dicarboxylic Acid of an Aromatic Compound

The present invention further comprises a 1,3-dicarboxylic acid or 1,4-dicarboxylic acid of an aromatic compound, or reactive equivalents thereof, or mixtures thereof, which is reacted or complexed with the dispersant. The term "reactive equivalents thereof" include acid halides, esters, amides or mixtures thereof. The "aromatic component" is typically a benzene (phenylene) ring or a substituted benzene ring, although other aromatic materials such as fused ring compounds or heterocyclic compounds are also contemplated. It is believed (without intending to be bound by any theory) that the dicarboxylic acid aromatic compound may be bound to the dispersant by salt formation or complexation, rather than formation of covalently bonded structures such as amides, which may also be formed but may play a less important role. Typically the presence of the dicarboxylic acid aromatic compound within the present invention is believed to impart corrosion inhibition properties to the composition. Examples of suitable dicarboxylic acids include 1,3-dicarboxylic acids such as isophthalic acid and alkyl homologues such as 2-methyl isophthalic acid, 4-methyl isophthalic acid or 5-methyl isophthalic acid; and 1,4-dicarboxylic acids such as terephthalic acid and alkyl homologues such as 2-methyl terephthalic acid. Other ring substituents such as hydroxy or alkoxy (e.g., methoxy) groups may also be present in certain embodiments. In one embodiment the aromatic compound is terephthalic acid.

(v) Phosphorus Acid Compound

In one embodiment the product prepared by heating is optionally prepared in the presence of a phosphorus acid compound. The phosphorus acid compound may contain an oxygen atom and/or a sulfur atom as its constituent elements, and is typically a phosphorus acid or anhydride. This component includes the following examples: phosphorous acid, phosphoric acid, hypophosphoric acid, polyphosphoric acid, phosphorus trioxide, phosphorus tetroxide, phosphorous pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid or their anhydrides are typically used. A salt, such as an amine salt of a phosphorus acid compound may also be used. It is also possible to use a plurality of these phosphorus acid compounds together. The phosphorus acid compound is often phosphoric acid or phosphorous acid or their anhydride.

The phosphorus acid compound may also include phosphorus compounds with a phosphorus oxidation of +3 or +5, such as, phosphates, phosphonates, phosphinates, or phosphine oxides. A more detailed description for these suitable phosphorus acid compounds is described in U.S. Pat. No. 6,103,673, column 9, line 64 to column 11, line 8.

In one embodiment the phosphorus acid compound is an inorganic phosphorus compound.

Additional Performance Additive

The composition optionally further includes at least one additional performance additive. The additional performance additives include metal deactivators, detergents, dispersants other than component (e) of the invention, viscosity modifiers, dispersant viscosity modifiers, extreme pressure agents, antiscuffing agents, antioxidants, foam inhibitors, demulsifiers, pour point depressants, seal swelling agents or mixtures thereof.

In several embodiments the total combined amount of the additional performance additive compounds are present from 0 wt % to 25 wt %, 0.01 wt % to 20 wt %, 0.1 wt % to 15 wt % or 0.5 wt % to 10 wt % of the lubricating composition. Although one or more of the additional performance additives may be present, it is common for the additional performance additives to be present in different amounts relative to each other.

If the present invention is in the form of a concentrate (which can be combined with additional oil to form, in whole or in part, a finished lubricant), the ratio of the oil soluble product of the invention and the optional additional performance additives in an oil of lubricating viscosity, to diluent oil including may be in the range of 80:20 to 10:90 by weight.

Antiscuffing agents including organic sulphides and polysulphides, such as benzyldisulphide, bis-(chlorobenzyl) disulphide, dibutyl tetrasulphide, di-tertiary butyl polysulphide, di-tert-butylsulphide, sulphurised Diels-Alder adducts or alkyl sulphenyl N'N-dialkyl dithiocarbamates. Antioxidants include molybdenum dithiocarbamates, sulphurised olefins, hindered phenols, diphenylamine. Detergents include neutral or overbased, Newtonian or non-Newtonian, basic salts of alkali, alkaline earth and transition metals with one or more of a phenate, a sulphurised phenate, a sulphonate, a carboxylic acid, a phosphorus acid, a mono- and/or a dithiophosphoric acid, a saligenin, an alkylsalicylate, a salixarate. Dispersants include N-substituted long chain alkenyl succinimide as well as posted treated version thereof. Post-treated dispersants include those treated by reaction with urea, thiourea, dimercaptothiadiazoles, carbon disulphide, aldehydes, ketones, carboxylic acids, hydrocarbon-substituted succinic anhydrides, nitriles, epoxides, boron compounds, or phosphorus compounds. Viscosity modifiers include hydrogenated copolymers of styrene-butadiene, olefin copolymers other than the oil soluble product of the invention (such as ethylene-propylene polymers, polyisobutenes, hydrogenated styrene-isoprene polymers, hydrogenated isoprene polymers), polymethacrylate acid esters, polyacrylate acid esters, polyalkyl styrenes, hydrogenated alkenyl aryl conjugated diene copolymers, polyalkylmethacrylates and esters of maleic anhydride-styrene copolymers.

Extreme Pressure (EP) agents including chlorinated wax, organic sulphides and polysulphides, such as benzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons, metal thiocarbamates, such as zinc dioctyldithiocarbamate and barium heptylphenol diacid. Any of the above classes of additives may also be used in the composition of the invention.

Additionally the invention may also include dispersant viscosity modifiers (often referred to as DVM), including functionalised polyolefins, for example, ethylene-propylene copolymers that have been functionalized with the reaction product of maleic anhydride and an amine; polymethacrylates functionalised with an amine, or styrene-maleic anhydride copolymers reacted with an amine.

Other performance additives such as metal deactivators including derivatives of benzotriazoles, 1,2,4-triazoles, benzimidazoles, 2-alkyldithiobenzimidazoles, dimercaptothiadiazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene copolymers, polymethacrylates, polyacrylates or polyacrylamides; and seal swell agents including Exxon Necton-37™ (FN 1380) and Exxon Mineral Seal Oil (FN 3200); may also be used in the composition of the invention.

Industrial Application

The lubricating composition of the invention is suitable for lubricants in a variety of mechanical devices, including internal combustion engines (diesel or gasoline powered, two or four stroke cycle), transmission (including transmissions for automobiles, trucks, and other equipment such as a manual transmission, an automatic transmission, an automated manual transmission, a continuously variable transmission, a dual clutch transmission, a farm tractor transmission, a transaxle, a heavy duty power-shift transmission, and wet brakes) as well as hydraulics or gears, such as, an automotive gear and a farm tractor gear.

In one embodiment of the invention provides a method for lubricating a transmission, comprising supplying thereto a lubricant comprising the lubricating composition as described herein. The use of the lubricating composition in a transmission may impart one or more properties selected from acceptable friction performance and durability, acceptable anti-shudder performance, acceptable oxidation resistance and acceptable gear protection.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The following examples provide illustrations of the invention. These examples are non exhaustive and are not intended to limit the scope of the invention.

EXAMPLES

Preparative Example 1

Terephthalic Acid+DMTD+Boric Acid

A reaction vessel with a 4-neck round bottom flask fitted with a mechanical stirrer, subsurface nitrogen sparge, thermowell, and Dean-Stark trap fitted with a condenser vented to caustic and bleach traps is charged with 2137 g succinimide dispersant (reaction product of polyisobutylene substituted succinic anhydride with polyethylene amine bottoms, containing diluent oil) and 1422 g additional diluent oil and is heated, with stirring, to 83° C. and 114 g of boric acid is added before heating to 152° C. over 2.5 hours and water is removed. To the mixture is added 1.16 g of terephthalic acid and the mixture is heated to 160° C. At 160° C. 25.2 g of 2,5-dimercapto-1,3,4-thiadiazole (DMTD) in portions such that each subsequent addition is effected after the previous portion has dissolved. The mixture is stirred until evolution of $H_2S$ ceases before filtration to produce a final product.

Preparative Example 2

DMTD+Boric Acid+Phosphorous Acid

Preparative Example 1 is substantially repeated except that 77.8 g phosphorous acid is added along with the boric acid.

Preparative Example 3

Mannich Dispersant

Preparative Example 1 is substantially repeated except that the dispersant is a Mannich dispersant.

Preparative Example 4

DMTD+Boric Acid

A 12 L, 4-neck round bottom flask fitted with a mechanical stirrer, subsurface nitrogen sparge, thermowell, and Dean-Stark trap fitted with a condenser vented to caustic and bleach traps is charged with 2751.5 g succinimide dispersant (reaction product of polyisobutylene substituted succinic anhydride with polyethylene amine bottoms, containing a total of 1100.6 g diluent oil) and 81.1 g additional diluent oil and is heated, with stirring, to 150° C. To the mixture is added 38.5 g of 2,5-dimercapto-1,3,4-thiadiazole (DMTD) in portions such that each subsequent addition is effected after the previous portion has dissolved. The mixture is stirred at 150° C. until evolution of $H_2S$ ceases. The temperature is then allowed to decrease to 90° C. and 83.1 g boric acid is added, after which the mixture is heated to 150° C. while removing water. When no more water is generated, the mixture is allowed to cool to 130° C. and is filtered through a filter pad packed with filter aid to provide a clear, dark colored product containing 40 percent diluent oil.

Preparative Example 5

DMTD+Boric Acid

To a 5 L flask equipped as in Example 1 is charged 2000 g of polyisobutylene-substituted succinic anhydride, including 640 g diluent oil, and the mixture is heated to 150° C. Monopentaerythritol (173.6 g) is added and the temperature is increased to 184° C. over 6 hours and maintained for 11 hours while removing water. Additional diluent oil (486.1 g) is added and the temperature is reduced to 160° C., at which time 31 g of polyamine bottoms (equivalent weight about 41) are added dropwise over an hour. The mixture is stirred at temperature for 1 hour, then cooled to 150° C. DMTD (48 g) is added as in Example 1, and the mixture stirred at 150° C. until $H_2S$ evolution ceases. The mixture is cooled to 90° C. and 80 g boric acid is added followed by stirring at 150° C. for an additional 12 hours. Isolation as in Example 1 provides a clear, dark colored product containing 40% diluent oil.

Examples 1 to 5

Examples 1 to 5 are prepared by blending the product of Preparative Examples 1 to 5 respectively at 4.5 wt % into an oil of lubricating viscosity along with 0.3 wt % of a dihydrocarbyl-substituted hydrogen phosphite, 0.65 wt % of a mixture of two friction modifiers and 0.08 wt % of a corrosion inhibitor.

Reference Example 1 is a commercially available ATF fluid.

Tests 1-8

Tests 1 to 3 are described in detail in the Ford Mercon® SP Specification Revised and Effective Jul. 1, 2004 for an Automotive Transmission Fluid. The methodology of Tests 1 to 3 are described as follows: Clutch Friction Durability (Mercon® SP Specification, Section 3.12, Pages 8-13); Anti-Shudder Durability (Mercon® SP Specification, Section 3.14, Pages 18-21); and ABOT performance (Mercon® SP Specification, Section 3.11 on Page 7) respectively.

Generally better results are obtained for Clutch Friction Durability (CFD) when after 30,000 cycles the average S1/D (Static/Dynamic Ratio) is below 1.05; and Midpoint Dynamic Friction is 0.14 as an average value over the duration of the test.

Generally better results are obtained for Anti-Shudder Durability tests when a positive slope dMu/dV is obtained throughout the test until the end of the test (i.e. at 100 hours).

Generally better results are obtained for ABOT performance for samples with a lower total acid number (TAN) and the lower percentage viscosity increase.

Test 4 is a Copper Strip test in the Ford Mercon® SP Specification (Section 3.5) and is based on ASTM method D130 (also defined in ISO 2160) at 150° C. and for a period of 3 hours. Generally passing results are observed for samples with a rating between 1a and 2c.

Test 5 is a Ford 4R75W Low Gear Fatigue Test. The Ford 4R75W Low Gear Fatigue is a steady state test employing a 6.8 liter V-10 engine with a dynamometer calibrated controller. The test has two phases, the first phase of the test is run with the transmission in second gear generating 760 lb*ft (about 36 kPa) of torque at 750 rpm output shaft speed for 35 hours or until failure. The second phase of the test is run with the transmission in first gear generating 1388 lb*ft (about 66.5 kPa) of torque at 450 rpm output shaft speed for 15 hours or until failure for a total of 50 hours. Fluid temperature is controlled as follows: case-out temperature=250° F. (about 121° C.) and case-in temperature=170° F. (about 77° C.). Typically, the test reports the number of hours to failure for each sample. Typically, a passing result is obtained if a sample run does not fail before 50 hours.

Test 6 is the Vane Pump Wear Test described in the Mercon® SP Specification, Section 3.8.1 and carried out using ASTM D 2882 at 80° C. and 6.9 MPa. Generally better results are obtained for samples with a weight loss of less than 10 mg.

Test 7 is the FZG Gear Wear Test described in the Mercon® SP Specification, Section 3.8.2 and carried out using D 5182 at 1450 rpm, 15 minutes and a starting temperature of 150° C. Generally better results are obtained for samples with less scuffing and a higher load stage pass.

Test 8 is a One Way Clutch Test (OWC). The OWC test is a modified Delphi one way clutch (OWC) using a roller style clutch. The test is run for 10 hours using an electric motor to rotate the inner race at 4500 rpm with the outer cam surface being held stationary. The sump size is 7 liters of fluid controlled to 240° F. (about 115° C.) and 390 ml/min flow rate through the clutch. Generally better results are obtained for samples showing no trenching after 10 hours.

The results obtained for Tests 1-8 are shown in Table 1 for Example 1 and Reference Example 1.

TABLE 1

| Test | Example 1 | Reference Example 1 |
|---|---|---|
| CFD | | |
| S1/D | 0.975 (Pass) | 1.065 (Fail) |
| Midpoint Dynamic F. | 0.142 (Pass) | 0.138 (Fail) |
| Anti-Shudder Durability | | |
| Slope | Positive | Negative |
| Time | 100 hours (Pass) | at 20 to 25 hours (Fail) |
| ABOT performance | | |
| TAN | 1.37 | 1.5 |
| % Viscosity Increase | 3.59% | 10% |
| Copper Strip Rating | 1B (Pass) | 1B to 2C (Pass) |
| 4R75W Low Gear Fatigue Test (50 hours) | 50 hours (Pass) | 48 hours (Fail) |
| Vane Pump Test (100 hours) | 0.7 mg loss (pass) | 10 mg |
| FZG Test | | |
| Load Stage | 12 (Pass) | 11 (Pass) |
| Scuffing | No scuffing (Pass) | 20 mm (acceptable) |
| OWC Test | 10 hours (Pass) | <8 hours (Fail) |
| | No trenching | Trenching observed |

Overall the results presented in Table 1 demonstrate the lubricating composition of the invention provides a mechanical device with one or more properties selected from acceptable friction performance and durability, acceptable anti-shudder performance, acceptable oxidation resistance and acceptable gear protection compared with the commercially available Reference Example.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

What is claimed is:

1. A lubricating composition comprising:

(a) an oil of lubricating viscosity;

(b) a friction modifier;

(c) a corrosion inhibitor;

(d) an antiwear agent; and (e) a product prepared comprising heating to react together:

(i) a dispersant;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) terephthalic acid; and (v) optionally a phosphorus acid compound, said heating being at 80-200° C. to provide a product of (i), (ii), (iii) and (iv) and optionally (v), which is soluble in an oil of lubricating viscosity.

2. The lubricating composition of claim 1, wherein the friction modifier comprises at least one of an amide of a hydroxyalkyl compound, a condensation product of a fatty acid and an amine, a borated glycerol ester, a fatty phosphite, a fatty acid amide, a fatty epoxide, a borated fatty epoxide, an alkoxylated fatty amine, a borated alkoxylated fatty amine, a metal salt of a fatty acid, a fatty imidazoline, an amine salt of an alkylphosphoric acid, a polyalkoxylated alcohol, or mixtures thereof.

3. The lubricating composition of claim 2, wherein the friction modifier comprises a condensation product of a fatty acid and an amine.

4. The lubricating composition of claim 1, wherein the friction modifier is present from 0.05 wt % to 10 wt % of the lubricating composition.

5. The lubricating composition of claim 1, wherein the corrosion inhibitor comprises 2,5-dimercapto-1,3-4-thiadiazole or a hydrocarbyl-substituted 2,5-dimercapto-1,3-4-thiadiazole, or oligomers thereof.

6. The lubricating composition of claim 1, wherein the corrosion inhibitor is present from 0.005 wt % to 5 wt % of the lubricating composition.

7. The lubricating composition of claim 1, wherein the antiwear agent comprises a hydrocarbyl-substituted phosphite, a phosphorus-containing carboxylic ester, a phosphorus-containing carboxylic ether, a phosphorus-containing carboxylic amide, or mixtures thereof.

8. The lubricating composition of claim 7, wherein the antiwear agent comprises a hydrocarbyl-substituted phosphite represented by the formula:

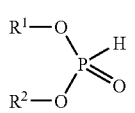

(I)

wherein $R^1$ and $R^2$ are independently hydrogen or hydrocarbyl groups, with the proviso that at least one of $R^1$ and $R^2$ is a hydrocarbyl group.

9. The lubricating composition of claim 1, wherein the antiwear agent is present from 0.05 wt % to 10 wt % of the lubricating composition.

10. The lubricating composition of claim 1, wherein the product (e) is present from 0.5 wt % to 15 wt % of the lubricating composition.

11. The lubricating composition of claim 1, wherein the dispersant of (e) comprises a succinimide dispersant, a Mannich dispersant, an ester-containing dispersant, a condensation product of a fatty hydrocarbyl monocarboxylic acylating agent with an amine or ammonia, an alkyl amino phenol dispersant, a hydrocarbyl-amine dispersant, a polyether dispersant, a polyetheramine dispersant, a viscosity modifier containing dispersant functionality, or mixtures thereof.

12. The lubricating composition of claim 1, wherein the borating agent of (e) comprises boric acid, boric oxide, boron trioxide, or an alkyl borate of the formula $(RO)_xB(OH)_y$, wherein x is 1 to 3 and y is 0 to 2 , the sum of x and y being 3, and where R is an alkyl group containing 1 to 6 carbon atoms.

13. A lubricating composition comprising:

(a) 40 wt % to 99.4 wt % of an oil of lubricating viscosity;

(b) 0.05 wt % to 10 wt % of a friction modifier;

(c) 0.005 wt % to 5 wt % of a corrosion inhibitor;

(d) 0.05 wt % to 10 wt % of a hydrocarbyl-substituted phosphite antiwear agent; and (e) 0.5 wt % to 15 wt % of a product prepared by heating to react together:

(i) a dispersant;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) terephthalic acid, said heating being at 80-200° C. to provide a product of (i), (ii), (iii) and (iv), which is soluble in an oil of lubricating viscosity.

14. A method for lubricating a mechanical device, comprising supplying thereto a lubricant comprising the lubricating composition of claim 1.

15. The method of claim 14, wherein the mechanical device comprises an automatic transmission, an automated manual transmission, a continuously variable transmission or a dual clutch transmission.

16. The method of claim 14, wherein the mechanical device comprises gears or hydraulics.

17. A lubricating composition comprising:

(a) an oil of lubricating viscosity;

(b) a friction modifier;

(c) a corrosion inhibitor;

(d) an antiwear agent; and (e) a product prepared comprising heating to react together:

(i) a dispersant, wherein the dispersant is selected from the group consisting of a succinimide dispersant, a Mannich dispersant, an ester-containing dispersant, a condensation product of a fatty hydrocarbyl monocarboxylic acylating agent with an amine or ammonia, an alkyl amino phenol dispersant, a hydrocarbylamine dispersant, a polyether dispersant, a polyetheramine dispersant, a viscosity modifier containing dispersant functionality, and mixtures thereof;

(ii) 2,5-dimercapto-1,3,4-thiadiazole or a hydrocarbyl-substituted 2,5-di-mercapto-1,3,4-thiadiazole, or oligomers thereof;

(iii) a borating agent; and (iv) terephthalic acid; and (v) optionally a phosphorus acid compound, said heating being at 80-200° C. to provide a product of (i), (ii), (iii) and (iv) and optionally (v), which is soluble in an oil of lubricating viscosity.

18. A method for lubricating a mechanical device, comprising supplying thereto a lubricant comprising the lubricating composition of claim 1, wherein the mechanical device comprises an automatic transmission, an automated manual transmission, a continuously variable transmission or a dual clutch transmission.

* * * * *